US007210185B2

(12) United States Patent
Paas

(10) Patent No.: US 7,210,185 B2
(45) Date of Patent: May 1, 2007

(54) FLOOR CLEANING DEVICE WITH MOTORIZED VIBRATORY HEAD

(75) Inventor: Edward L. Paas, Los Altos, CA (US)

(73) Assignee: S.C. Johnson & Son, Inc., Racine, WI (US)

( * ) Notice: Subject to any disclaimer, the term of this patent is extended or adjusted under 35 U.S.C. 154(b) by 429 days.

(21) Appl. No.: 10/726,055

(22) Filed: Dec. 2, 2003

(65) Prior Publication Data

US 2004/0107522 A1 Jun. 10, 2004

Related U.S. Application Data

(60) Provisional application No. 60/430,721, filed on Dec. 3, 2002.

(51) Int. Cl.
*A47L 11/00* (2006.01)

(52) U.S. Cl. ..... 15/49.1; 15/97.1; 15/98

(58) Field of Classification Search ..... None
See application file for complete search history.

(56) References Cited

U.S. PATENT DOCUMENTS

| | | | | |
|---|---|---|---|---|
| 3,608,108 | A | 9/1971 | Sawyer | |
| 3,657,759 | A | 4/1972 | Sawyer | 15/98 |
| 3,803,666 | A | 4/1974 | Sawyer | |
| 3,883,260 | A | 5/1975 | Heckner | |
| 4,103,519 | A | 8/1978 | Davidson | |
| 4,105,024 | A | 8/1978 | Raffel | |
| 4,499,779 | A | 2/1985 | Maass | |
| 4,570,616 | A | 2/1986 | Kunz et al. | |
| 5,169,445 | A | 12/1992 | Yonehara et al. | 118/63 |
| 5,309,593 | A * | 5/1994 | Yonehara | 15/92 |
| 5,471,695 | A | 12/1995 | Aiyar | |
| 5,483,718 | A * | 1/1996 | Blehert et al. | 15/50.3 |
| 5,596,787 | A | 1/1997 | Stevens et al. | 15/220.1 |
| 5,890,249 | A | 4/1999 | Hoffman | 15/4 |
| 5,950,270 | A * | 9/1999 | Tono | 15/98 |
| 6,133,657 | A | 10/2000 | Semenik et al. | 310/81 |
| 6,253,405 | B1 | 7/2001 | Gutelius et al. | |
| 6,353,964 | B1 | 3/2002 | Andrisin, Jr. et al. | |
| 2002/0066153 | A1 | 6/2002 | Sclafani et al. | 15/347 |
| 2006/0010625 | A1 * | 1/2006 | Tapper et al. | 15/97.1 |

FOREIGN PATENT DOCUMENTS

| | | |
|---|---|---|
| EP | 0756875 A2 | 2/1997 |
| WO | WO 97/07896 | 3/1997 |
| WO | WO 00/51747 | 9/2000 |
| WO | WO02/092405 A1 | 11/2002 |

* cited by examiner

*Primary Examiner*—David Redding

(57) ABSTRACT

A vibratory cleaning/polishing head secured to manually operated handle includes a detachable cleaning/polishing pad secured to the head, and a rechargeable battery and vibratory unit including a motor. In one embodiment, the vibratory unit and battery are substantially contained within the head housing. In another embodiment the vibratory unit and battery are situated atop of the housing.

The motor contains a driveshaft to which an eccentric element is secured. The driveshaft extends substantially parallel to the horizontal upper surface of the head, wherein vibration of the head in a vertical plane is induced for enhancing efficacy of cleaning/polishing.

In one embodiment, the device has two vibratory units secured to the head, each spaced from the other on laterally opposed sides of attachment yoke. The units operate in the 2,500 to 8,000 RPM range.

20 Claims, 2 Drawing Sheets

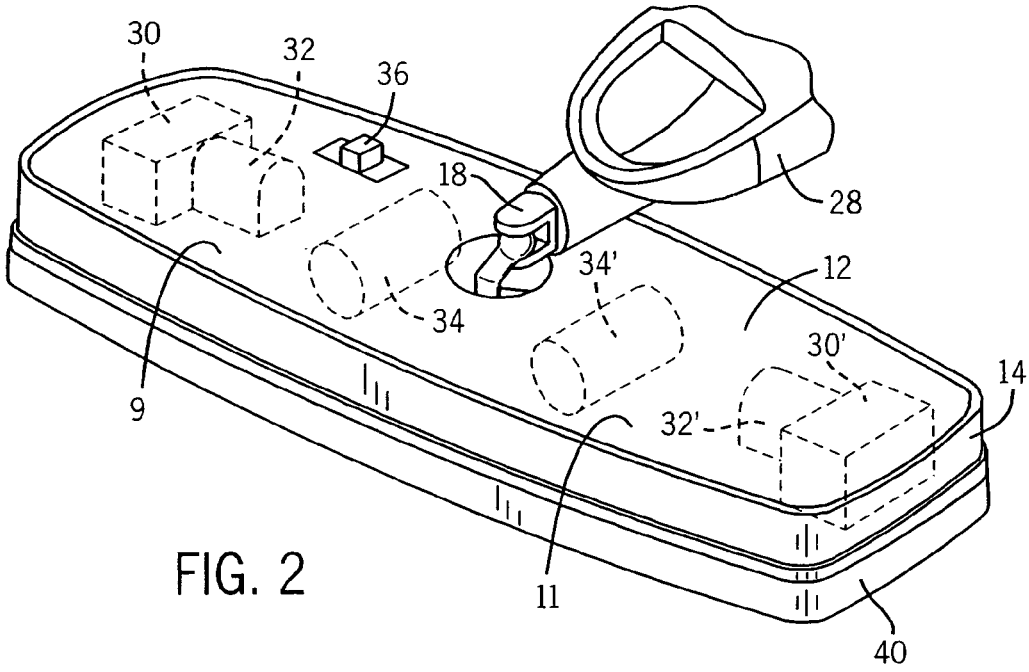
FIG. 2
FIG. 3
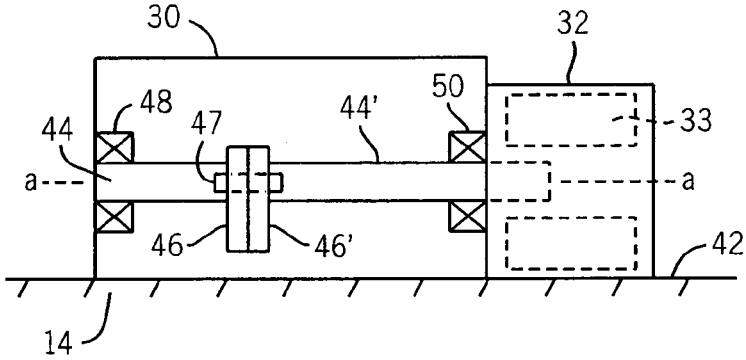
FIG. 4
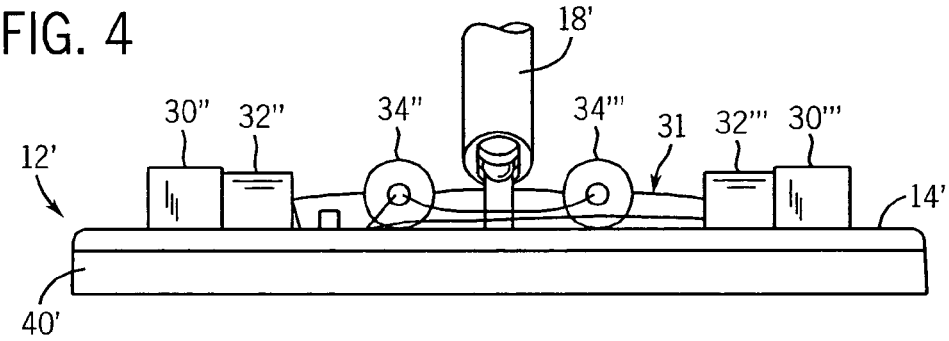

FLOOR CLEANING DEVICE WITH MOTORIZED VIBRATORY HEAD

CROSS-REFERENCE TO RELATED APPLICATION

This application claims priority to U.S. Provisional Application No. 60/430,721, filed Dec. 3, 2002.

STATEMENT OF FEDERALLY SPONSORED RESEARCH OR DEVELOPMENT

Not applicable.

BACKGROUND OF THE INVENTION

The present invention relates to cleaning implements, and in particular to powered devices for cleaning hard surfaces, such as wood and vinyl floors commonly found in homes and/or residential living quarters.

Household cleaning materials are well known, as is their use with cleaning pads. Powered devices have been developed to make easier the process of applying such materials, and to improve cleaning efficacy of heavily soiled surfaces. Several such devices comprise electrically powered hand-held apparatus. Some of such devices involve linear reciprocal motion and/or orbital motion of cleaning pads or sponges. Each of these powered devices generally includes a housing containing a drive motor with a rotating shaft that either rotates or reciprocates (in a straight horizontal or orbital path) a cleaning head, via suitable coupling between the rotating, vertically oriented, drive shaft and the cleaning head.

Some devices involve attached replaceable cleaning pads to the cleaning head, for example, using hook and loop attachments, such as Velcro® brand fasteners (e.g. U.S. Pat. No. 6,253,405).

Other devices employ separately contained cleaning/polishing compounds applied to the cleaning head or directly to the surface being cleaned. Still others incorporate such compounds within the device or within the pads, for example, by pre-impregnating pads that are attached to the heads. However, there is no known powered cleaning device with a mop-styled handle, which utilizes the combination of dual motored, induced direct up and down, i.e. vertical plane oriented, vibration to enhance efficacy of the cleaning agents and/or cleaning pads secured to mop heads.

Accordingly, such an improved powered cleaning device would be useful, particularly for cleaning hard surfaced floors.

SUMMARY OF THE INVENTION

In one described embodiment, the invention provides a powered cleaning device with a mop-style handle, having dual motors with associated vibration units mounted on opposed lateral portions of a mop head. The mop head is secured to the bottom of the mop handle, and the handle is attached to the mop head housing via a flexible oscillatory yoke. Drive shafts extend horizontally from motors which, in one embodiment, are mounted internally within the head. The motor shafts are affixed to rotary driven shafts having eccentric weights that impart substantially vertical vibrations to the head housing. The housing is thereby induced to vibrate up and down with respect to a floor over which the device is being operated, whenever the motors are actuated. As part of the overall cleaning device structure, a fluid cleaning composition is dispensed to the floor surface via a fluid canister actuated by a handle-mounted trigger spray mechanism.

In one described form the fluid cleaning composition is carried in an aerosol can, and its dispersal is triggered by and from the mop handle. Alternatively, the fluid cleaning composition may be carried in a fluid bottle with a similarly actuated trigger spray mechanism.

Another embodiment of the invention provides a mop handled powered cleaning implement with dual motors for generating counteracting vibratory cleaning capability, wherein each laterally spaced vibratory unit operates out of phase or non-synchronously with respect to the other. For this purpose, each vibratory unit is eccentrically coupled to its respective motor drive shaft so that when a horizontal driven shaft (of the vibratory unit) is rotated the mop head vibrates in a generally vertical or up and down fashion with respect to the floor. The result is a non-synchronized mode of operation, wherein each lateral head portion or side moves in a back-and-forth oscillatory motion about the mop head yoke, thus inducing a side-to-side slapping motion of mop head on the floor.

In one envisioned embodiment, the vibratory units, as well as the motors are separate, and each is detachable from the housing head. In addition, the vibratory units and motors are situated atop of the head, separate and distinct from removable cleaning pads adapted to be fixed to the bottom of the head.

In the several forms described, the apparatus is powered by batteries that may be rechargeable, and that are disposed in or atop of the head housing. At least one power switch is electrically coupled between respective batteries and motors, with only one switch being normally preferred, even for dual motored systems. The single "on-off" switch is actuated by foot for manufacturing simplicity. Moreover, the motors are each adapted to reciprocate the housing head within a speed range that falls between 500 and 8,500 cycles per minute.

The head housing ideally comprises a substantially rigid body. As a result, it is feasible to control, including dampen, levels of vibration otherwise imparted to both the cleaning apparatus including its handle. A layer (or layers) of foam can be interposed between the head (containing the vibrating mechanism) and the handle for this purpose.

The cleaning pad contemplated herein can include woven or non-woven materials, including cloth, micro-fibers, rubbers, and polymers. Cleaning pad materials having bristles or foam rubber-like characteristics are also potentially feasible. Various surface treatment compositions can employ any room temperature physical state including liquid, gel, paste, solid and granular. Such surface treatment compositions are preferably cleansers or polishes, or any of surfactants, solvents, chelants, biocides, builders, abrasives, polymers, pH adjusters, bleaches, waxes, silicones, fluorocarbons, perfumes and dyes. Depending on a particular embodiment, the surface treatment composition can be applied directly to the cleaning device, or can alternatively be applied directly to the floor.

These and other features of the invention will be apparent from the detailed description and the drawings presented herewith, as representative of several currently envisioned embodiments of the present invention.

BRIEF DESCRIPTION OF THE DRAWINGS

FIG. ("FIG.") 1 is a perspective view of a mop handled, powered cleaning/polishing device according to the present invention, some of the interior components shown partially in phantom.

FIG. 2 is an enlarged perspective view of the mop head of the device of FIG. 1.

FIG. 3 is a cross-sectional view of one vibratory unit and its associated electric motor, revealing details of drive and driven shafts, and the eccentric weights affixed thereto, in one described embodiment.

FIG. 4 is an elevation view of an alternate embodiment, wherein vibratory units, motors, and batteries are fixed externally, i.e. to the upper exterior surface, of the mop head housing.

DETAILED DESCRIPTION OF EMBODIMENTS

Figure 1:
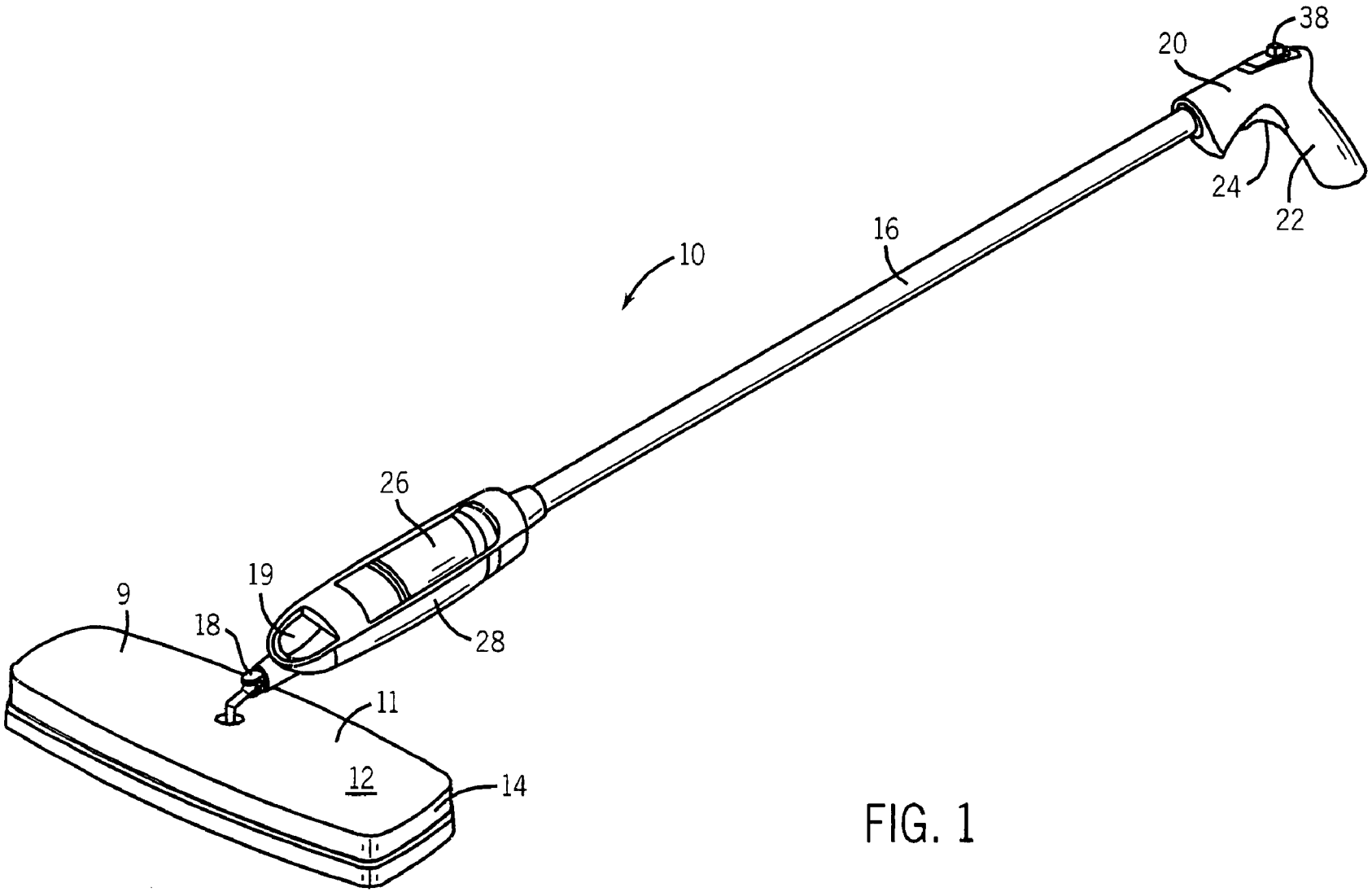

The present invention provides a manual handle-operated motorized device designed for cleaning and/or scrubbing of hard floor surfaces such as found in kitchens and bathrooms, wherein the floors are more often susceptible to caked-on food, dirt, mildew, and or other stubborn cleaning issues. It should be noted that the described device is not necessarily limited to cleaning, but may also be used for buffing and or polishing, or other treatment of hard floor surfaces. Thus, the inventive device is also capable of performing a variety of non-cleaning functions even though the various features and components of the inventive device are specifically discussed herein solely within the context of cleaning. As such, it is to be observed that there is no intentional effort herein to exclude suitability or desirability of non-cleaning applications with respect to the inventive device described.

Additionally, the terms "vibrate" and "reciprocate" are used interchangeably herein, and mean back and forth or oscillatory motion, either along a relatively straight line or in a substantially straight path.

Referring initially to FIG. 1, a powered cleaning device 10 is constructed in accordance with the herein-described invention. The device 10 has a head 12 that is preferably made of a rigid plastic (instead of metal) for optimizing cleaning efficacy and economy. The head 12 defines a head housing 14 that is secured to a manually operated handle 16 (also a plastic part) via an attachment yoke 18. Optionally, a foam or cushion layer (not shown) may be interposed between the attachment yoke 18 and the housing 14 to assure insulation and or dampening of vibrations between the housing and handle.

An ergonomically designed trigger portion 20 is situated at the end of the handle opposite the head 12. A contoured hand grip 22 of the trigger portion 20 is also formed of plastic, and is adapted to facilitate grasping of the device with either hand during use. The hand grip 22 contains a spring-loaded trigger mechanism 24 as part of a system designed to actuate an aerosol canister 26. The canister 26 contains a cleaning solution adapted to be sprayed out of a nozzle (not shown) situated in the canister end 19. The canister 26 may be latched or otherwise fixed into place within a canister holder 28.

The head 12 has an elongated lateral dimension greater than its front to rear dimension. As such, distinctive left and right half portions 9 and 11 define lateral sides of the head 12, respectively positioned on either side of the attachment yoke 18.

The head housing 14 contains the power and drive components (discussed below), supporting the components within and to its interior body. The housing 14 has an opening (not shown) for a power socket to recharge batteries, a foot-operated power switch 36, and openings (none shown) for the removal and changing of defective components.

Referring next to FIG. 2, a more detailed view of internal components contained within the head 12 is provided. Left and right half portions 9 and 11 are virtual mirror images of each other, and share like numbered components distinguished only by primes. Thus, each vibratory unit 30 is coupled directly to and driven by an electric motor 32. The electric motors are powered by batteries 34 (which may or may not be rechargeable), and are actuated by the foot-operated switch 36. Hardwired electrical circuitry (not shown) connects all of the described actuated components. It will be appreciated by those skilled in the art that the switch 36 is interposed between the motors 32 and batteries 34, and operates to open and close, i.e. to "switch", an electrical circuit running between the latter components.

In operation, the motors of the cleaning device 10 are switched on via the on-off switch 36. In a first mode of operation, the motors 34 will rotated at virtually equal speeds. The ultimate objective is to enhance cleaning efficacy of the cleaning pad 40. However, in a second mode of operation, a non-synchronous speed switch 38 (FIG. 1), situated on the trigger portion 20 of the mop handle 16, causes the motors to operate at different speeds in a manner that a beat frequency is created. This phenomenon operates to induce an oscillatory back-and-forth vibratory motion of the head 12 about the mop head attachment yoke 18, inducing a side-to-side slapping motion of mop head 12 against a floor surface to further enhance efficacy of cleaning in particularly difficult cleaning circumstances.

Referring now to FIG. 3, a more detailed view of the vibratory unit 30 and electric motor 32 is presented. It will be appreciated that both the vibratory unit 30 and electric motor 32 are secured to a floor 42 of the head housing 14. Referring back to FIG. 2, it will also be appreciated that the cleaning pad 40 is removably secured to bottom side of the same floor 42. A set of windings 33 contained within the motor encircles a motor drive shaft 44' coupled to a driven shaft 44. Excitation of the windings produces rotation of the motor shaft 44', and because the shafts are coupled together by mating flanges 46, 46', the shafts rotate about a common centerline a—a oriented parallel to the floor 42. In the described embodiment, the shafts are secured together by a plurality of fastening members 47, and are supported on bearings 48 and 50, as shown. Also, in the environment described, the two mating flanges 46 of the driven and drive shafts 44 together form an eccentric weight 46 adapted to rotate with the shafts 44 to produce the desired vibration.

Finally, an additional embodiment of the head 12' is depicted in FIG. 4. The vibratory units 30, electric motors 32, and the batteries 34 are all situated atop of a modified housing 14'. Those skilled in the art will appreciate that this version represents a substantially economical approach relative to the versions already described. To the extent that all of the components are exposed, it is suggested that they be encapsulated with a type of vinyl or thin molded plastic covering, even transparent if desired, to protect the electrical component parts from an otherwise inevitable intrusion of cleaning solution moisture. It will also be noted that in this version the wires 31 are external or uncovered as well, and would thus also be desirably insulated or sealed against intrusion of moisture.

It will be appreciated that the various described embodiments of the invention are merely examples of currently envisioned constructions. Numerous modifications and or variations of the described embodiments will become apparent to those skilled in the art, and may fall within the spirit and scope of the as-claimed invention. Therefore, this invention is not limited only to the described embodiments.

INDUSTRIAL APPLICABILITY

The invention provides an improved powered cleaning device.

What is claimed is:

1. A cleaning device comprising:

a) a cleaning head including a housing;

b) a manually operated handle, said handle flexibly coupled to said cleaning head and adapted to oscillate with respect thereto;

c) at least one powered vibratory unit mounted in or on said housing;

d) a rechargeable battery disposed within the housing for powering the at least one powered vibratory unit;

e) a power switch electrically coupled between the battery and the motor;

f) a yoke coupling the handle at the housing; and g) two separate motors, one on each side of said head, said yoke interposed between each motor, wherein said at least one vibratory unit imparts a substantially vertically oriented vibration to said cleaning head to enhance efficacy of cleaning.

2. The device of claim 1, wherein at least one motor is an electric motor.

3. The device of claim 2, wherein said motor comprises a drive shaft, and said vibratory unit comprises a driven shaft coupled to said drive shaft; said driven shaft comprising an eccentric weight affixed thereto, said shafts mounted horizontally so as to be substantially parallel to an upper laterally extending portion of said housing so as to produce said vibration having a substantially vertical component relative to a hard floor surface to be cleaned.

4. The device of claim 3, further comprising a control for producing differing relative motor speeds to create a beat frequency, and wherein a lateral rocking motion of the head is induced about said yoke.

5. The device of claim 3, further including a foam layer interposed between said cleaning head and said handle to so as to reduce transmission of vibration from said cleaning head to said handle.

6. The device of claim 1, wherein the unit is adapted to reciprocate between about 2,500 and 8,500 cycles per minute.

7. A device for cleaning a hard floor surface, comprising:

a) a head configured to clean the hard floor surface, the head including a housing;

b) a manually operated handle, said handle coupled by a yoke to said housing;

c) first and second powered vibratory units mounted in or on said housing;

d) a first motor located on a first lateral side of said head, and a second motor located on a second lateral side of said head opposite the first lateral side, the yoke interposed between the first and second lateral sides;

d) a rechargeable battery disposed within the housing for powering each first and second motor; and e) a power switch electrically coupled between the first and second batteries and the first and second motors, wherein both first and second vibratory units impart a substantially vertically oriented vibration to the respective first and second lateral sides of said head when cleaning the floor surface.

8. The device of claim 7, further comprising a control mechanism that produces a distinctive difference in relative speeds of said first and second motors creating a beat frequency, and wherein a lateral rocking motion of the head is induced about said yoke for enhanced efficacy of cleaning.

9. The device of claim 7, wherein the head includes a cleaning pad configured to engage the hard surface floor.

10. The device of claim 7, wherein each of said first and second motors comprise a drive shaft, and wherein each of said first and second vibratory units comprise a driven shaft respectively coupled to said drive shaft of said first and second motors; said driven shaft comprising an eccentric weight affixed thereto, said shafts mounted horizontally so as to be substantially parallel to an upper laterally extending portion of said housing so as to produce said vibration having a substantially vertical component.

11. The device of claim 7, further including a foam layer interposed between said head and said handle to reduce the transmission of vibration from said head to said handle.

12. The device of claim 7, further comprising a second switch, wherein the second switch in a first position causes a distinctive difference in relative speeds of said first and second motors creating a beat frequency so as to induce a lateral rocking motion of the head, and wherein the second switch in a second position causes the first and second motors to operate at generally equal speeds.

13. A device for cleaning a hard floor surface, comprising:

a) a head configured to clean the floor surface;

b) a manually operated handle coupled by a yoke to said head;

c) a first powered vibratory unit mounted at a first lateral side of the head, and a second powered unit mounted at a second lateral side of the head opposite the first lateral side, the yoke located between the first and second powered vibratory units;

d) a first motor connected to power the first vibratory unit, and a second motor connected to power the second vibratory unit, and the yoke interposed between each motor;

e) a battery disposed at the head for powering each first and second motor, wherein each of the first and second vibratory units impart a substantially vertically oriented vibration to said head when cleaning the floor surface, and wherein a difference in relative speeds of said first and second motors creates a beat frequency so as to create a lateral rocking motion of the head about said yoke.

14. The device of claim 13, wherein the head includes a cleaning pad configured to engage the hard surface floor.

15. The device of claim 13, wherein each of said first and second motors comprise a drive shaft, and wherein each of said first and second first and second vibratory units comprise a driven shaft coupled to said drive shaft of each of said first and second motors, respectively, said driven shaft comprising an eccentric weight affixed thereto, both said drive and driven shafts mounted horizontally so as to be substantially parallel to an upper laterally extending portion of said housing so as to produce said vibration having a substantially vertical component.

16. The device of claim 13, further comprising a second switch, wherein the second switch in a first position causes a distinctive difference in relative speeds of said first and second motors creating a beat frequency so as to induce a lateral rocking motion of the head, and wherein the second switch in a second position causes the first and second motors to operate at generally equal speeds.

17. The device of claim 13, further including a power switch electrically coupled between both first and second batteries and both of said first and second motors.

18. The device of claim 17, further comprising a trigger mechanism configured to actuate an aerosol canister so as to spray cleaning solution from the canister to the hard surface floor.

19. The device of claim 1, further comprising a trigger portion coupled to the handle to spray a cleaning solution.

20. The device of claim 1, wherein certain components of the device are encapsulated in a transparent covering.

* * * * *